US006476357B2

(12) United States Patent
Ohno et al.

(10) Patent No.: US 6,476,357 B2
(45) Date of Patent: Nov. 5, 2002

(54) FIXING DEVICE PROVIDED WITH A FIXING BELT

(75) Inventors: Yasuhiro Ohno, Ibaraki (JP); Toshiya Natsuhara, Takarazuka (JP); Eiichi Sano, Itami (JP); Ken Tanino, Ibaraki (JP); Yoshihiro Fukuhata, Takarazuka (JP); Masami Miyazaki, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/032,574

(22) Filed: Jan. 2, 2002

(65) Prior Publication Data

US 2002/0125237 A1 Sep. 12, 2002

(30) Foreign Application Priority Data

Jan. 9, 2001 (JP) ..... 2000-000933

(51) Int. Cl.[7] ..... G03G 15/20
(52) U.S. Cl. ..... 219/216; 399/329
(58) Field of Search ..... 219/216, 469; 399/329–332

(56) References Cited

U.S. PATENT DOCUMENTS 5,257,078 A * 10/1993 Kuroda ..... 399/329
5,724,628 A 3/1998 Sano
5,758,245 A 5/1998 Matsuura et al.
5,778,294 A * 7/1998 Hiraoka et al. ..... 399/329
5,784,678 A 7/1998 Matsuura et al.
5,832,353 A 11/1998 Sano
5,839,043 A 11/1998 Okabayashi et al.
5,873,020 A 2/1999 Matsuura et al.
5,890,032 A * 3/1999 Aslam et al. ..... 399/329

FOREIGN PATENT DOCUMENTS

JP 9-114283 5/1997

* cited by examiner

*Primary Examiner*—Joseph Pelham
(74) *Attorney, Agent, or Firm*—Morrison & Foerster LLP

(57) ABSTRACT

The fixing device of the present invention comprises a heating roller having an internal heating device; a flexible fixing belt wrapped around the exterior side of the heating roller and having a circumferential length longer than the circumferential length of the heating roller; and a pressure roller for pressing against the heating roller through the fixing belt, wherein a slack part of the fixing belt is formed on the downstream side from the pressure contact part between the heating roller and the pressure roller in the direction of transport of the recording medium, such that this slack part touches the exterior surface of the pressure roller.

12 Claims, 6 Drawing Sheets

FIXING DEVICE PROVIDED WITH A FIXING BELT

The present invention is based on Japanese Patent Application No. 2001-000,933, the entire content of which is incorporated by reference.

BACKGROUND OF THE INVENTION

1. Field of the Invention

The present invention relates to a fixing device for use in fixing toner on a recording medium in an image forming apparatus such as a copier, printer and the like.

2. Description of the Related Art

In conventional image forming apparatuses such as copiers, printers and the like, tone is supplied to a recording medium, and the toner is fixed to the recording medium by a fixing device.

As show in FIG. 1, such a conventional fixing device generally guides a recording medium 1 supplied with a toner t between a pair of fixing rollers so as to fix the toner t to the recording medium 1 between the pair of fixing rollers 2 and 3.

Furthermore, in order to adequately fix the toner t to the recording medium 1, heaters 4 and 5 are provided within each fixing roller 2 and 3, and elastic layers 2*a* and 3*a* are provided on the exterior surface of the fixing rollers 2 and 3, so as to heat the fixing rollers 2 and 3 via the heaters 4 and 5, and press together the fixing rollers 2 and 3, thereby increasing the length of the nip part between the elastic layers 2*a* and 3*a* provided on the exterior surface of the fixing rollers 2 and 3, such that the toner t is fixed to the recording medium 1 via adequate heat and pressure.

In recent years, however, such image forming apparatuses have been designed for high-speed operation requiring that the toner t is adequately fixed to the recording medium 1 at high speed, and in full color image forming apparatuses, further necessitating that toner t of a plurality of colors is supplied to the recording medium 1 forming a thick layer of toner t, and the thick layer of toner t must be adequately fixed to the recording medium 1.

In such fixing devices, in order to adequately heat fix the toner t to the recording medium 1 at high speed and adequately fix the thick layer of toner t to the recording medium 1, the length of the nip part applying heat and pressure on the toner t must be increased between the fixing rollers 2 and 3.

Methods have been considered wherein the diameter of each fixing roller 2 and 3 is increased, and the elastic layers 2*a* and 3*a* provided on the exterior surface of the fixing rollers 2 and 3 are thickened to increase the length of the nip part between the fixing rollers 2 and 3.

When the diameters of the fixing rollers 2 and 3 are increased, however, a problem arises in that the fixing device becomes larger, and the recording medium 1 readily wraps around the fixing roller 2 in contact with the toner t. Further problems arise when the elastic layers 2*a* and 3*a* provided on the exterior surface of the fixing rollers 2 and 3 are thickened, in that heat transfer to the exterior surface of the fixing rollers 2 and 3 becomes difficult, such that the toner t cannot be adequately heated, the toner t cannot be adequately fixed to the recording medium 1, and more power is required to adequately heat the exterior surface of the fixing rollers 2 and 3, thereby increasing the running cost of the device.

In recent years, belt fixing devices have been proposed, such as that disclosed in Japanese Laid-Open Patent No. H9-114283, wherein an endless-type fixing belt is looped around a heating roller and a plurality of support rollers, such that the heating roller is pressed against a pressure roller through the fixing belt, and the fixing belt is pressed against the pressure roller via a pressure contact member on the downstream side, such that the nip region between the fixing belt and the pressure roller is lengthened, and the toner is fixed to the recording medium in this nip region.

In the case of such a belt fixing device, however, problems arise in that the fixing device becomes larger because the fixing belt moves while looped around the heating roller and a plurality of support rollers, thereby enlarging the image forming apparatus. Further problems arise inasmuch as the fixing belt cools while is moving looped around the heating roller and a plurality of support rollers, such that toner cannot be adequately heated to be fixed to the recording medium, and in order to adequately fix toner to the recording medium severe heating conditions are necessary for heating the fixing belt via the heating roller, thereby increasing the running cost, and requiring a warm-up time in order to heat the plurality of support rollers via the fixing belt.

Furthermore, in the case of conventional belt fixing devices, the recording medium curls so as to generate wrinkles in the nip part formed by the fixing belt and the roller, and coiling and jamming of the recording medium may occur.

SUMMARY OF THE INVENTION

An object of the present invention is to provide a belt fixing device capable of adequately fixing toner to a recording medium without enlarging the device or increasing the running cost.

Another object of the present invention is to provide a belt fixing device which controls curling and wrinkling of the recording medium so as to make coiling and jamming difficult to occur.

The fixing device of the present invention comprises a heating roller having an internal heating is device; a flexible fixing belt wrapped around the exterior side of the heating roller and having a circumferential length longer than the circumferential length of the heating roller; and a pressure roller for pressing against the heating roller through the fixing belt, wherein a slack part of the fixing belt is formed on the downstream side from the pressure contact part between the heating roller and the pressure roller in the direction of transport of the recording medium, such that this slack part touches the exterior surface of the pressure roller.

DESCRIPTION OF THE PREFERRED EMBODIMENTS

The embodiments of the fixing device of the present invention are described hereinafter with reference to the accompanying drawings.

Figure 1:
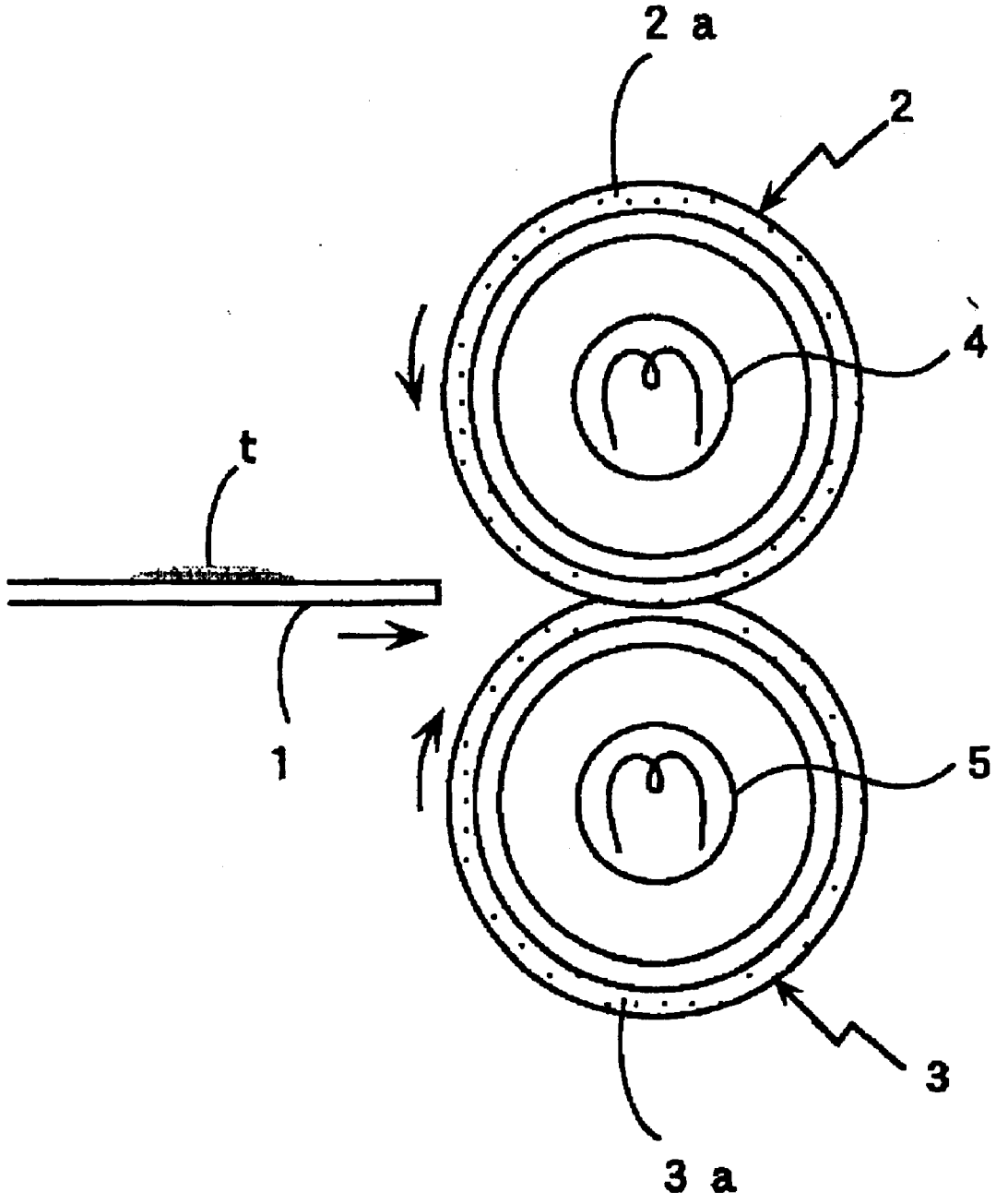
FIG. 1 briefly illustrates a conventional fixing device wherein a recording medium bearing toner is guided between a pair of fixing rollers to fix the toner on the recording medium.
Figure 2:
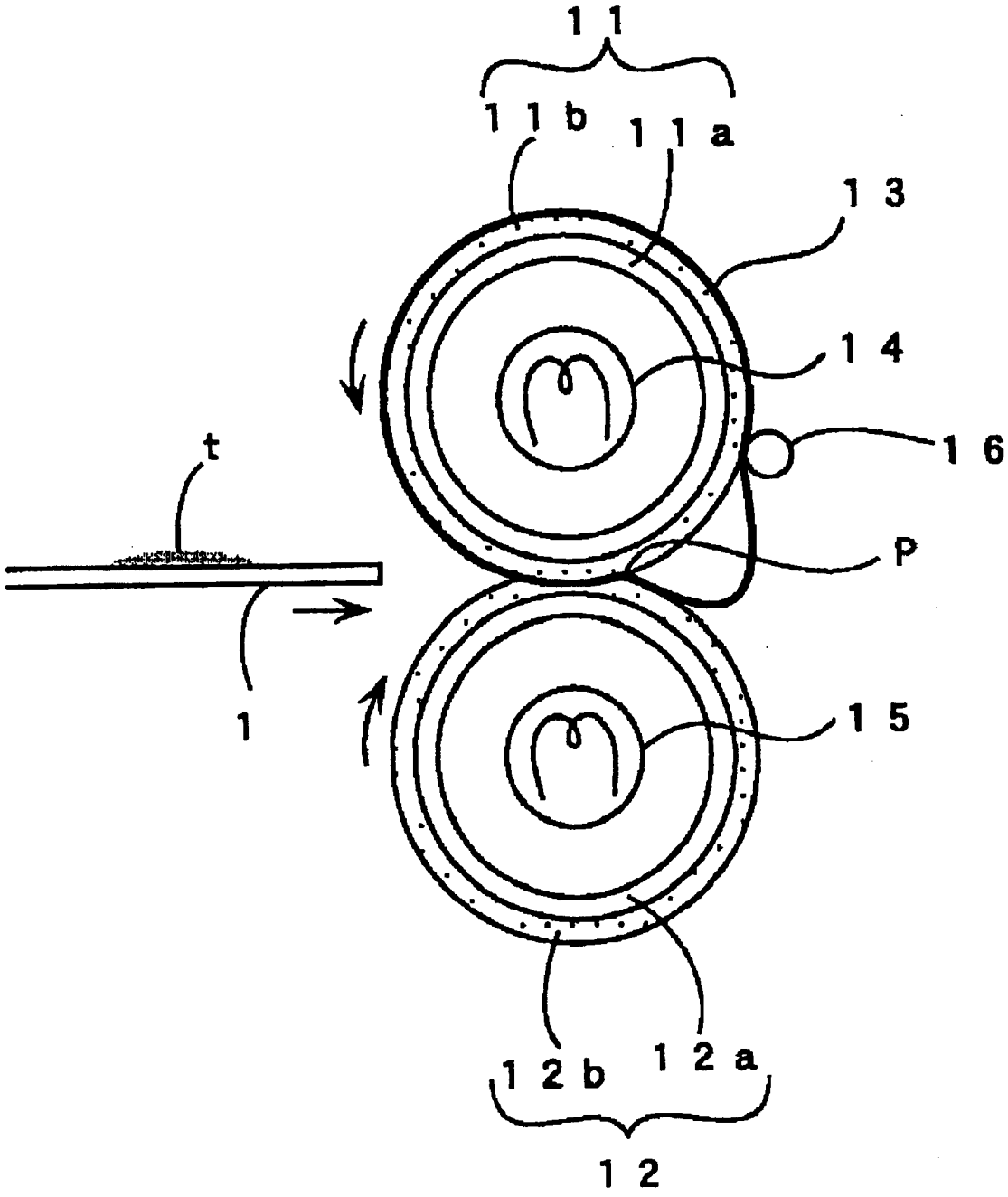
FIG. 2 briefly illustrates an embodiment of the fixing device of the present invention.

As shown in FIG. 2, the fixing device of this embodiment is provided with a pair of opposed fixing rollers 11 and 12 respectively provided with an elastic layer 11*b* and 12*b* on the exterior surface of a cylindrical tube-like metal core 11*a* and 12*a*, a flexible fixing belt 13 having a circumferential length longer than the circumferential length of the fixing roller 11 and which is looped around the exterior surface of the fixing roller 11 opposite the surface of a recording medium 1 bearing toner t, and heating devices 14 and 15 such as halogen heaters or the like built in each fixing roller 11 and 12. The fixing roller 11 is equivalent to a heating roller, and the fixing roller 12 is equivalent to a pressure roller.

A nip part is formed by the pressure contact of the pair of fixing rollers 11 and 12 through the fixing belt 13, and the fixing belt 13 is pressed against the exterior surface of the fixing roller 11 along the axial direction of one fixing roller 11 via a cylindrical pressing member 16, and a slack part is formed in the fixing belt 13 which separates from the exterior surface of the fixing roller 11 on the downstream side from the nip part in the direction of transport of the recording medium, and this slack part touches the exterior surface of the fixing roller 12.

In the formation of the nip part via pressure contact between the pair of fixing rollers 11 and 12, the elastic layer 12*b* of the fixing roller 12 becomes more depressed than the elastic layer 11*b* of the fixing roller 11, such that the slack part of the fixing roller 13 has an inflexion point P from the nip part to the touching part of touching contact with the exterior surface of the other fixing roller 12.

In the adhesion of the toner t to the recording medium 1, the fixing rollers 11 and 12 and the fixing belt 13 are heated by the heating devices 14 and 15, and the fixing belt 13 moves on the exterior side of the fixing roller 11 in conjunction with the rotation of the fixing rollers 11 and 12.

The recording medium 1 is guided between the fixing belt 13 and the fixing roller 12 such that the surface of the recording medium 1 bearing the toner t touches the fixing belt 13, and the recording medium 1 bearing the toner t is nipped between the heated fixing roller 12 and fixing belt 13 in the nip part, and the toner t on the recording medium 1 is heated and subjected to pressure so as to be fixed to the recording medium 1. Then, the recording medium 1 is further nipped in the touching contact area wherein the slack part of the fixing belt 13 touches the fixing roller 12 on the downstream side from the nip part in the direction of transport of the recording medium 1 so as to fix the toner t on the recording medium 1.

In this way, the recording medium 1 bearing the toner t is nipped longer by the fixing roller 12 and the fixing belt 13, and the toner t on the recording medium 1 is adequately fixed to the recording medium 1.

In the stage where the recording medium 1 separates from the touching contact area after the toner t is fixed to the recording medium 1 in the aforesaid manner, the curvature of the fixing belt 13 is reduced, and the temperature of the fixing belt 13 decreases a certain degree, such that the toner t fixed to the recording medium 1 is also cooled a certain degree and adhesion of the toner t on the fixing belt 13 is suppressed, the recording medium 1 readily separates from the fixing belt 13, and coiling of the recording medium 1 around the fixing belt 13 is prevented.

Since the slack part of the fixing belt 13 has an inflexion point P from the nip part to the touching contact area of touching contact with the exterior surface of the fixing roller 12, the bending force on the recording medium 1 is increased in the reverse direction at the border of the inflexion point P, thereby suppressing bending of the recording medium 1, and providing even more prevention of coiling of the recording medium 1 around the fixing belt 13.

It is desirable that the metal cores 11*a* and 12*a* of the fixing rollers 11 and 12 are formed of materials having excellent mechanical strength and thermal conductivity, e.g., metals such as aluminum, SUS, iron, copper, brass and the like and alloys thereof, and materials such as ceramics, fiber-reinforced metals and the like.

Furthermore, well-known elastic materials may be used as the material of the elastic layers 11*b* and 12*b* provided on the exterior surface of the metal cores 11*a* and 12*a*, e.g., silicone rubber, fluoro rubber and the like may be used, however, silicone rubber is desirable due to its low surface tension and excellent elasticity and thermal stability. RTV silicone rubber, HTV silicone rubber and the like may be used as the silicone rubber material, specifically, polymethyl silicone rubber (MQ), methylphenyl silicone rubber (PMQ), methylvinyl silicone rubber (VMQ), fluoro silicone rubber (FVMQ) and the like may be used.

It is desirable that the rubber hardness of the elastic layers 11*b* and 12*b* are 1 to 30 degrees, and more desirably 1 to 10 degrees, based on JIS hardness A to both increase thermal efficiency and allow formation of a suitable nip part through deformation of the elastic layers 11*b* and 12*b*.

The elastic layers 11*b* and 12*b* are provided on the exterior surface of the metal cores 11*a* and 12*a*; when the elastic layers 11*b* and 12*b* are too thick, it becomes difficult for heat to be transferred from the heating devices 14 and 15 to the exterior surfaces of the fixing rollers 11 and 12, and large amounts of power and time are required to heat the fixing belt to a specific temperature, such that the thickness of the elastic layers 11*b* and 12*b* is desirably less than 5 mm, and more desirably less than 3 mm. On the other hand, when the elastic layers 11*b* and 12*b* are too thin, the length of the nip part is too short when the fixing rollers 11 and 12 are pressed together, and there is concern that the toner t cannot be adequately fixed to the recording medium 1. For these reasons, the thickness of the elastic layers 11*b* and 12*b* is desirably within a range of 0.1 to 2.0 mm; however, the elastic layer 11*b* may be omitted from the fixing roller 11 around which is looped the fixing belt 13 as necessary to increase thermal efficiency.

In order to form an inflexion point P by the elastic layer 12*b* of the fixing roller 12 being more depressed than the elastic layer 11*b* of the fixing roller 11 when the pair of fixing rollers 11 and 12 are pressed together, the elastic layer 12*b* of the fixing roller 12 may be constructed, for example, of a softer material than the elastic layer 11*b* of the fixing roller 11, the thickness of the elastic layer 12*b* of the fixing roller 12 may be thicker than the thickness of the elastic layer 11*b* of the fixing roller 11, or these adjustments may be used in combination.

When the elastic layer 12*b* of the fixing roller 12 is constructed of softer elastic material than the elastic layer 11*b* of the fixing roller 11 and there is little difference in the rubber hardness in the two elastic layers 11*b* and 12*b*, a well-defined nip part cannot be formed, whereas when the difference in rubber hardness is too great, the depression in the elastic layer 12*b* of the fixing roller 12 is excessively large, causing wrinkling of the recording medium 1 when the toner t is fixed onto the recording medium 1. Therefore, it is desirable that the difference in rubber hardness of the two elastic layers 11*b* and 12*b* is within a range of 1 is to 20 degrees, and more desirably 5 to 10 degrees, based on JIS hardness A.

The thickness of the elastic layer 12*b* of the fixing roller 12 is greater than the thickness of the elastic layer 11*b* of the fixing roller 11. When there is little difference in the thickness of both elastic layers 11*b* and 12*b*, a well defined concave-shaped nip part cannot be formed, whereas when there is too great a difference in the thickness of the elastic layers 11*b* and 12*b*, the depression of the elastic layer 12*b* of the fixing roller 12 becomes excessively large and the recording medium 1 becomes wrinkled when the toner t is fixed onto the recording medium 1. Therefore it is desirable that the difference in the thickness of both elastic layers 11*b* and 12*b* is within a range of 0.2 to 3 mm, and more desirably 0.5 to 2 mm.

The rubber hardness and thickness of the elastic layers 11*b* and 12*b* of the fixing rollers 11 and 12 may be respectively modified and adjusted.

Although it is possible to omit the elastic layer 11*b* from the exterior surface of the fixing roller 11, when the layer 11*b* is omitted, it becomes difficult to ensure a nip part of adequate length between the fixing rollers 11 and 12, and the thickness of the elastic layer 12*b* of the fixing roller 12 is desirably within a range of 0.5 to 3 mm, and more desirably 1 to 2 mm.

The elastic layers 11*b* and 12*b* may be provided on the exterior surface of the metal cores 11*a* and 12*a*, for example, by a liquid application prepared using the same material such as rubber or the like used in the elastic layers 11*b* and 12*b*, and this liquid application may be applied to the exterior surface of the metal cores 11*a* and 12*a* via well-known coating methods and dried. Examples of useful well-known coating methods include kneader coating, bar coating, curtain coating, spin coating, dip coating and the like. From the perspective of mass production qualities, it is desirable that a dip coating method is used.

Figure 3:
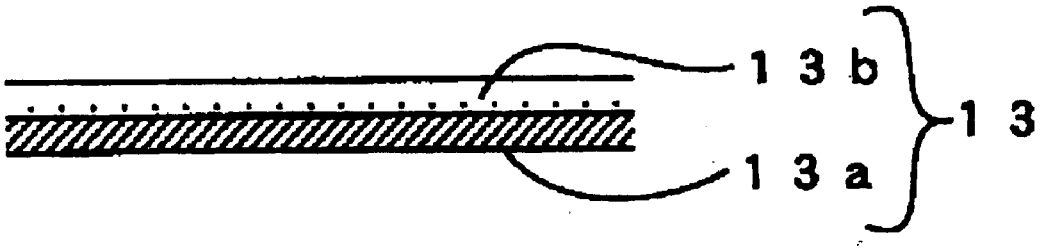
FIG. 3 is a cross section view showing the fixing belt used in this embodiment of the fixing device.
Figure 4:
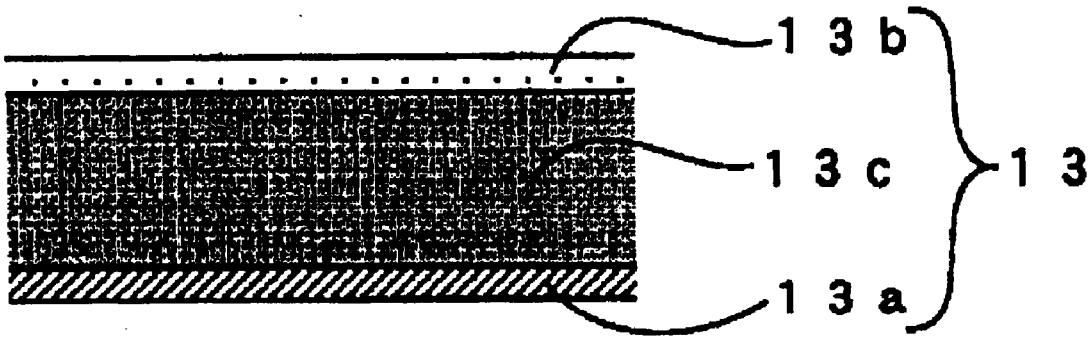
FIG. 4 is across section view showing a modification of the fixing belt used in this embodiment of the fixing device.

On the other hand, various belts may be used as the fixing belt 13, e.g., a belt comprising a release layer 13*b* provided on the surface of a belt substrate 13*a*, as shown in FIG. 3, and a belt comprising an elastic layer 13*c* interposed between a belt substrate 13*a* and a release layer 13*b*, such as shown in FIG. 4.

Examples of useful materials for the belt substrate 13*a* include polymers such as thermosetting polyimide, thermoplastic polyimide, polyamideimide and the like, ands metals such as stainless steel, nickel, copper and the like. However, from the perspective of increasing heat resistance, wear resistance, and chemical resistance of the fixing belt 13, the use of a belt substrate 13*a* constructed of thermosetting polyimide is desirable, whereas the use of a belt substrate 13*a* constructed of a metal such as stainless steel, nickel, copper and the like is desirable to achieve rapid and uniform heating of the fixing belt 13.

The material for the release layer 13*b* desirably has low adhesion properties relative to the toner t, e.g., fluoro rubber, silicone rubber, fluoro resin and the like; the use of a fluoro resin is particularly desirable.

Examples of useful fluoro resins suitable for the release layer 13*b* include perfluoroalkoxyfluoro resin (PFA), polytetrafluoroethylene (PTFE), tetrafluoroethylene-hexafluoropropylene copolymer (FEP), polyethylene-tetrafluoroethylene (ETFE), polyvinylidene fluoride (PVDF), polychlorotrifluoroethylene (PCTFE), polyvinylfluoride (PVF) and the like. Examples of useful fluoro rubbers for forming the release layer 13*b* include fluorovinylidene rubber, fluorosilicone rubber, tetrafluoroethylene-propylene rubber, fluorophosphazene rubber, tetrafluoroethylene-perfluorovinyl ether (perfluoro) rubber and the like.

The material of the elastic layer 13*c* of the fixing belt 13 may be an elastic material identical to the elastic material of the elastic layers 11*b* and 12*b* of the fixing rollers 11 and 12.

The release layer 13*b* and elastic layer 13*c* may be provided on the surface of the fixing belt 13 by liquid applications prepared using materials of the release layer 13*b* and elastic layer 13*c*, and this liquid application may be applied via well-known coating methods and dried similar to when providing elastic layers 11*b* and 12*b* on the fixing rollers 11 and 12.

When the thickness of the fixing belt 13 is increased, in general the softness of the fixing belt 13 decreases, and large amounts of power and time are required to heat the fixing belt. On the other hand, when the fixing belt 13 is too thin, the fixing belt 13 deforms only slightly in the nip part when the fixing rollers 11 and 12 are pressed together, and there is concern that the toner t will not be subjected to adequate pressure. For these reasons, the thickness of the fixing belt 13 is desirably within a range of 50 to 500 $\mu$m, and more desirably 100 to 300 $\mu$m; it is further desirable that the thickness is less than 200 $\mu$m so that the fixing belt 13 can be rapidly heated.

In the fixing belt 13, since the softness of the fixing belt 13 is reduced when the thickness of the belt substrate 13*a* is too thin, the thickness is desirably less than 100 $\mu$m, and more desirably in a range of 10 to 70 $\mu$m.

When the release layer 13*b* is provided, the thickness of this layer is normally in a range of 5~100 $\mu$m, and more desirably 10 to 30 $\mu$m.

When an elastic layer 13*c* is interposed between the belt substrate 13*a* and the release layer 13*b* as shown in FIG. 4, large amounts of power and time are required to heat the fixing belt 13 when the elastic layer 13*c* is too thick, such that it is desirable that the elastic layer 13*c* normally has thickness less than 500 $\mu$m, and more desirably less than 300 $\mu$m.

On the other hand, when the elastic layer 13*c* is thick, the elastic layer 13*c* deforms in the nip part formed by the pressure contact between the fixing rollers 11 and 12, such that the fixing belt 13 makes excellent touching contact with the toner t on the recording medium 1, and the toner t is adequately fixed on the recording medium 1. Even when the layer of toner t is thick due to the presence of toners t of a plurality of colors, the toner t can be adequately fixed on the recording medium 1 so as to produce an excellent full color image; therefore, when producing full color images, the thickness of the elastic layer 13*c* is desirably 100 μm or greater.

In order to suppress offset caused by adhesion of the toner t to the fixing belt 13 and suitably separate the recording medium 1 from the fixing belt 13, a release agent such as silicone oil, fluoro oil or the like may be supplied to the surface of the fixing belt 13 in contact with the toner t.

In order to suitably control the temperature of the fixing belt 13, the temperature of the fixing be t13 may be monitored by a thermistor, temperature sensor or the like, so as to control the heating devices 14 and 15 via various control device (not shown) based on the monitored temperature.

A slack part is formed in the fixing belt 13 and this slack part touches the exterior surface of the fixing roller 12. Since the fixing roller 13 is pressed against the exterior surface of the fixing roller 11 along the axial direction of the fixing roller 11 via a cylindrical pressing member 16, there is little stress added to the fixing belt 13 and the fixing belt 13 can be used for a long period, and dissipation of the heat of the fixing belt 13 to the pressing member 16 is also slight. Furthermore, in order to rapidly heat the fixing belt 13, a heating device (not shown) such as a halogen lamp or the like may be built into the pressing member 16, a plurality of channels (not shown) may be provided in the surface of the pressing member 16 to adjust the friction force relative to the fixing belt 13, and soiling of the fixing belt 13 may be eliminated by the pressing member 16, and a release oil may be applied to the fixing belt 13 so as to prevent adhesion of toner t to the fixing belt 13.

Figure 5:
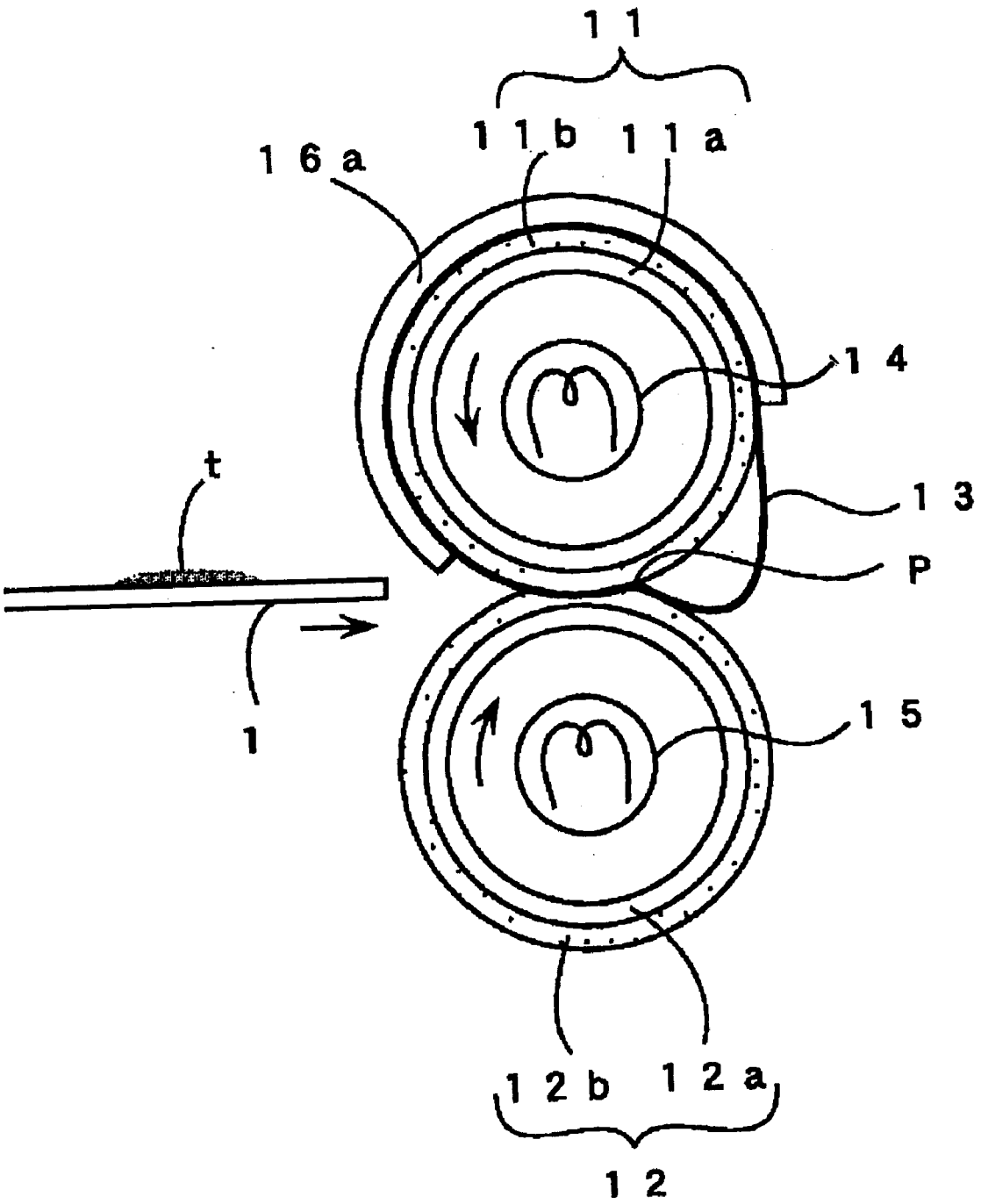
FIG. 5 briefly shows a modification when a slack part is formed in the fixing belt provided on the exterior surface of one fixing roller in an embodiment of the fixing device of the present invention.

The method of forming the slack part in the fixing belt 13 and having this slack part touch the exterior surface of the fixing roller 12 is not specifically limited to the previously described method. For example, it is possible to have, as shown in FIG. 5, an arc-shaped pressing member 16*a* press the fixing belt 13 against the exterior surface of the fixing roller 11 in the part which does not have the slack part, so as to form a slack part in the fixing belt 13 in the part wherein the fixing belt 13 is not pressed against the exterior surface of the fixing roller 11 (i.e., the part of the fixing belt downstream from the nip art in the direction of transport of the recording medium 1 ), such that the slack part touches the exterior surface of the fixing roller 12. In this way, a stable slack part is formed in the fixing belt 13 on the downstream side from the nip part in the direction of transport of the recording medium 1.

Figure 6:
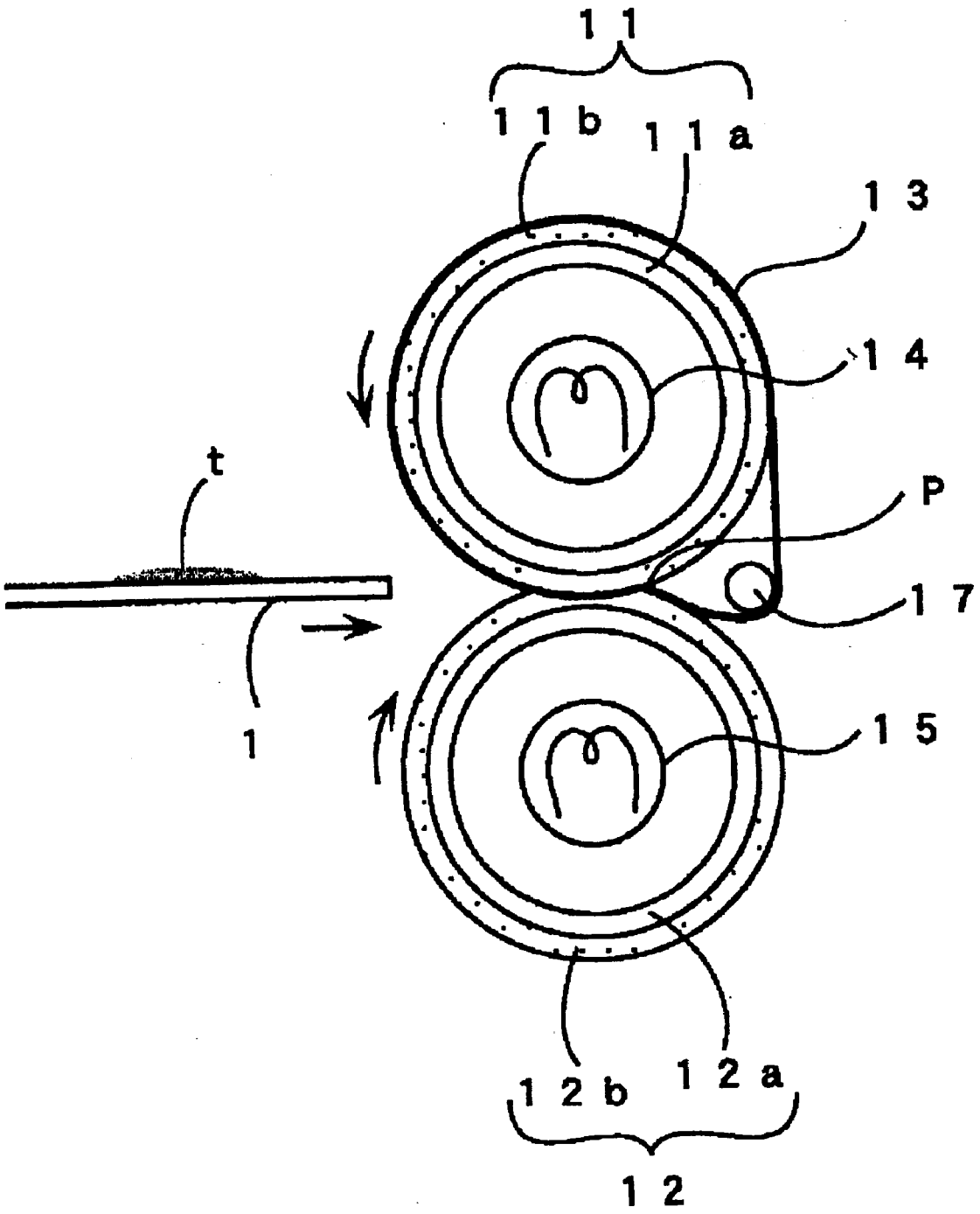
FIG. 6 briefly shows a modification of the embodiment of the fixing device of the present invention, wherein a fixing belt provided on the exterior surface of one fixing roller is looped around one guide roller provided on the downstream side of the nip part in the direction of transport of the recording medium, and the fixing belt touches the exterior surface of the other fixing roller on the downstream side of the nip part in the direction of transport of the recording medium.
Figure 7:
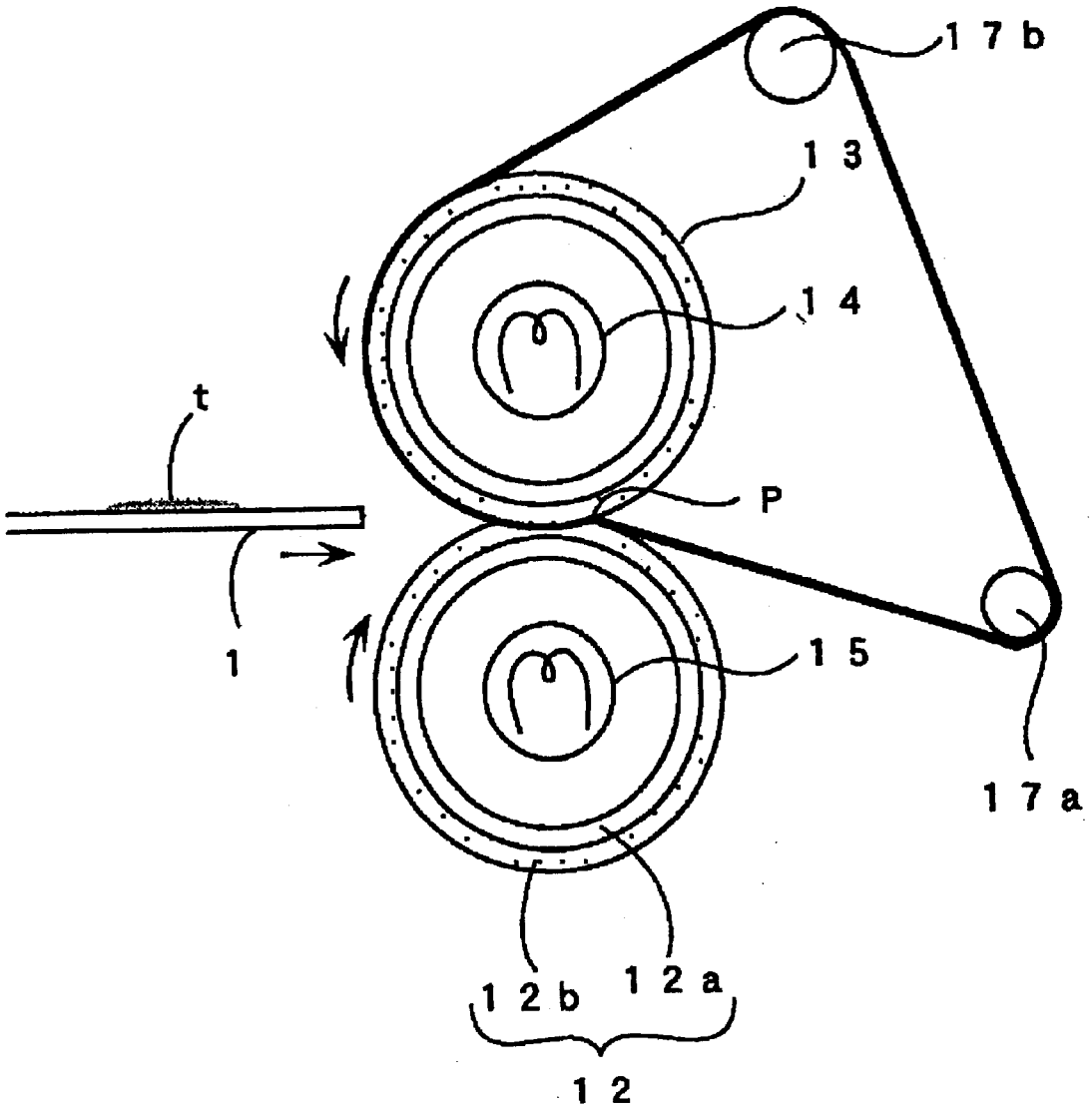
FIG. 7 briefly shows a modification of the embodiment of the fixing device of the present invention, wherein a fixing belt provided on the exterior surface of one fixing roller is looped around two guide rollers provided on the downstream side of the nip part in the direction of transport of the recording medium, and the fixing belt touches the exterior surface of the other fixing roller on the downstream side of the nip part in the direction of transport of the recording medium.

As shown in FIG. 6, when the fixing belt 13 provided on the exterior surface of the fixing roller 11 is looped around one guide roller 17 provided on the downstream side from the nip part in the direction of transport of the recording medium 1, the fixing belt 13 touches the exterior surface of the fixing roller 12 downstream from the nip part in the direction of transport of the recording medium 1. As shown in FIG. 7, when the fixing belt 13 provided on the exterior surface of the fixing roller 11 is looped around two guide rollers 17*a* and 17*b* provided on the downstream side from the nip part in the direction of transport of the recording medium 1, the fixing roller 13 touches the exterior surface of the fixing roller 12 downstream from the nip part in the direction of transport of the recording medium 1.

Experiments were performed using the fixing device shown in FIG. 2 in which the types of elastic layers 11*b* and 12*b* provided on the exterior surfaces of the fixing rollers 11 and 12 were changed and toner t was fixed onto a recording medium 1. Desirable combinations of elastic layers 11*b* and 12*b* provided on the exterior surfaces of the fixing rollers 11 and 12 were investigated.

EXAMPLE 1

In this example, a fixing belt provided with belt substrate 13*a* having an internal diameter of 65 mm and thickness of 50 μm, on the surface of which were sequentially superimposed a rubber elastic layer 13*c* having a thickness of 200 μm, and a release layer 13*b* formed of perfluoroalkoxyfluoro resin having a thickness of 30 μm was used as the fixing belt 13.

Rollers having a major diameter of 60 mm were used as the fixing rollers 11 and 12.

An elastic layer 11*b* having a thickness D1 set at 0 mm, 0.1 mm, and 2.0 mm was provided on the exterior surface of the fixing roller 11, and an elastic layer 12*b* having a thickness D2 which was varied was provided on the exterior surface of the fixing roller 12 so as to provide elastic layers 11*b* and 12*b* having a rubber hardness of 10 degrees on the exterior surface of the fixing roller 11 and the fixing roller 12, and the difference (D2–D1 ) between the thickness D2 of the elastic layer 12*b* on the fixing roller 12 and the thickness D1 of the elastic layer 11*b* on the fixing roller 11 was varied.

The fixing temperature was set at 180° C., and fixing speed was set at 200 mm/sec. Toner t was fixed to a recording medium 1 comprising 1,000 sheets of A4 size, and the fixing performance was evaluated. Evaluation results are shown in Table 1.

Fixing performance was evaluated as follows. The symbol ◎ represents the absence of wrinkling and curling in all 1,000 fixed sheets; the symbol ○ represents wrinkling or curling in one or two recording media; the symbol Δ represents one or two jams due to wrinkling or curling in 2~10 recording media; and the symbol X represents three or more jams due to wrinkling or curling in 10 or more recording media.

TABLE 1

| | Fixing performance | | | | | | | | | |
|---|---|---|---|---|---|---|---|---|---|---|
| D1 | D2–D1 (mm) | | | | | | | | | |
| (mm) | 0 | 0.1 | 0.2 | 0.4 | 0.5 | 1.0 | 1.5 | 2.0 | 3.0 | 3.5 |
| 0 | X | Δ | Δ | Δ | ○ | ◎ | ◎ | ◎ | ○ | Δ |
| 0.1 | X | Δ | ○ | ○ | ◎ | ◎ | ◎ | ◎ | ○ | Δ |
| 2.0 | X | Δ | ○ | ◎ | ◎ | ◎ | ◎ | ○ | ○ | Δ |

The results show that when elastic layers 11*b* and 12*b* having a rubber hardness of 10 degrees were respectively provided on the exterior surfaces of the fixing roller 11 and fixing roller 12, wrinkling and curling of the recording medium was suppressed when the difference in the thickness of the elastic layers 11*b* and 12*b* (D2–D1) was within the range of 0.2 to 3 mm.

Furthermore, when the elastic layer 11*b* was not provided on the exterior surface of the fixing roller 11, wrinkling and curling of the recording medium was suppressed when the thickness of the elastic layer 12*b* of the fixing roller 12 was within a range of 0.5 to 3 mm.

EXAMPLE 2

In this example, rollers having a major diameter of 60 mm were used as the fixing rollers 11 and 12, similar to example 1.

The rubber hardness Si of the elastic layer 11*b* provided on the exterior surface of the fixing roller 11 was set at 1 degree, 10 degrees, and 30 degrees, and the rubber hardness S2 of the elastic layer 12*b* provided on the exterior surface of the fixing roller 12 was varied, so as to provide elastic layers 11*b* and 12*b* of 1 mm on the exterior surface of the fixing roller 11 and the fixing roller 12, and the difference (S1–S2) between the rubber hardness S1 of the elastic layer 11*b* on the fixing roller 11 and the rubber hardness S2 of the elastic layer 12*b* on the fixing roller 12 was varied.

Similar to example 1, the fixing temperature was set at 180° C., and fixing speed was set at 200 mm/sec. Toner t was fixed to a recording medium 1 comprising 1,000 sheets of A4 size, and the fixing performance was evaluated. Evaluation results are shown in Table 2.

TABLE 2

| | Fixing performance | | | | | | | | | |
|---|---|---|---|---|---|---|---|---|---|---|
| S1 | S1–S2 (degree) | | | | | | | | | |
| (degree) | 0 | 1 | 2 | 4 | 5 | 10 | 15 | 20 | 30 | 35 |
| 0 | X | ○ | ○ | ○ | ◎ | ◎ | ◎ | ◎ | ○ | Δ |
| 0.1 | X | ○ | ○ | ◎ | ◎ | ◎ | ◎ | ○ | Δ | X |
| 2.0 | X | ○ | ○ | ◎ | ◎ | ◎ | ○ | ○ | X | X |

The results show that when elastic layers 11*b* and 12*b* of 1 mm were respectively provided on the exterior surface of the fixing roller 11 and the fixing roller 12, wrinkling and curling of the recording medium was suppressed when the difference (S1–S2) in the rubber hardness between the elastic layers 11*b* and 12*b* was within a range of 1 to 20 degrees.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A fixing device for fixing toner on a recording medium comprising:

a heating roller having an internal heating device;

a flexible fixing belt wrapped around the exterior side of the heating roller and having a circumferential length longer than the circumferential length of the heating roller; and a pressure roller for pressing against the heating roller through the fixing belt, wherein a slack part of the fixing belt is formed on the downstream side from the pressure contact part between the heating roller and the pressure roller in the direction of transport of the recording medium, such that this slack part touches the exterior surface of the pressure roller.

2. The fixing device of claim 1, wherein the heating roller comprises an elastic layer having a thickness of less than 5 mm, and the pressure roller comprises an elastic layer having a thickness of less than 5 mm.

3. The fixing device of claim 2, wherein the elastic layer of the pressure roller has the thickness greater than that of the elastic layer of the heating roller.

4. The fixing device of claim 3, wherein the thickness of the elastic layer of the heating roller and the thickness of the elastic layer of the pressure roller have a difference of 0.2 to 3 mm.

5. The fixing device of claim 1, wherein the heating roller comprises an elastic layer having a rubber hardness of 1 to 30 degrees, and the pressure roller comprises an elastic layer having a rubber hardness of 1 to 30 degrees.

6. The fixing device of claim 5, wherein the elastic layer of the heating roller has the rubber hardness greater than that of the elastic layer of the pressure roller.

7. The fixing device of claim 6, wherein the rubber hardness of the elastic layer of the heating roller and the rubber hardness of the elastic layer of the pressure roller have a difference of 1 to 20 degrees.

8. The fixing device of claim 1, wherein the pressure roller comprises an elastic layer having a thickness of less than 5 mm, and the heating roller does not comprise an elastic layer.

9. The fixing device of claim 1, wherein the fixing belt has a thickness of 50 to 500 $\mu$m and comprises a belt substrate and a release layer.

10. The fixing device of claim 9, wherein the fixing belt comprises an elastic layer interposed between the belt substrate and the release layer.

11. The fixing device of claim 1, wherein the slack part of the fixing belt has a point of inflexion between the pressure contact part and the touching contact part.

12. The fixing device of claim 1, wherein the pressure roller has an internal heating device.

* * * * *